US006753845B1

(12) United States Patent
Keeney et al.

(10) Patent No.: US 6,753,845 B1
(45) Date of Patent: Jun. 22, 2004

(54) METHODS AND APPARATUS FOR ADDRESSING PIXELS IN A DISPLAY

(75) Inventors: Richard A. Keeney, Eagan, MN (US); Farhad Nourbakhsh, Apple Valley, MN (US)

(73) Assignee: Electronics for Imaging, Inc., Foster City, CA (US)

( * ) Notice: Subject to any disclaimer, the term of this patent is extended or adjusted under 35 U.S.C. 154(b) by 578 days.

(21) Appl. No.: 09/705,407

(22) Filed: Nov. 3, 2000

(51) Int. Cl.[7] ..... G09G 3/34
(52) U.S. Cl. ..... 345/108; 345/110; 345/31
(58) Field of Search ..... 345/108, 87, 110, 345/85, 55, 173, 30, 31

(56) References Cited

U.S. PATENT DOCUMENTS

| | | | | |
|---|---|---|---|---|
| 4,126,854 | A | 11/1978 | Sheridon | |
| 4,208,103 | A | 6/1980 | Kalt | |
| 4,646,107 | A | 2/1987 | Shimizu | |
| 4,693,557 | A | 9/1987 | Fergason | |
| 4,733,950 | A | 3/1988 | Takubo et al. | |
| 4,786,898 | A | 11/1988 | Hata | |
| 5,389,945 | A | 2/1995 | Sheridon | |
| 5,554,434 | A | 9/1996 | Park | |
| 5,726,679 | A | 3/1998 | Kanno | |
| 5,949,391 | A | 9/1999 | Saishu | |
| 5,961,804 | A | 10/1999 | Jacobson | |
| 6,017,584 | A | 1/2000 | Albert | |
| 6,069,603 | A * | 5/2000 | Knapp | 345/91 |
| 6,473,072 | B1 * | 10/2002 | Comiskey et al. | 345/173 |

FOREIGN PATENT DOCUMENTS

| | | |
|---|---|---|
| GB | 936967 | 9/1963 |

OTHER PUBLICATIONS

*Patent Abstracts of Japan*, Abstract of Japanese Patent "Display Device", Publication No. 621346020, Jun. 17, 1987, Japanese Application No. 60275317, Filed Dec. 6, 1985.

*Patent Abstracts of Japan*, Abstract of Japanese Patent "Display Device", Publication No. 62143017, Jun. 26, 1987, Japanese Application No. 60283474, Filed Dec. 17, 1985.

* cited by examiner

*Primary Examiner*—Dennis-Doon Chow
(74) *Attorney, Agent, or Firm*—Barry R. Lipsitz; Douglas M. McAllister

(57) ABSTRACT

The present invention relates to methods and apparatus for addressing pixels in a display. More particularly, the present invention relates to methods and apparatus for addressing pixels in a display using one or more movable mechanical scanning mechanisms. The mechanical scanning mechanisms and one or more stationary addressing elements provide electrical field addressing for control of the desired pixel(s) in a display.

26 Claims, 6 Drawing Sheets

METHODS AND APPARATUS FOR ADDRESSING PIXELS IN A DISPLAY

BACKGROUND OF THE INVENTION

The present invention relates to methods and apparatus for addressing pixels in a display. More particularly, the present invention relates to methods and apparatus for addressing pixels in a display using one or more moving mechanical scanning mechanisms. The one or more movable mechanical scanning mechanisms (also referred to herein as "moving addressing elements") and one or more stationary addressing elements provide electrical field addressing for control of the desired pixel(s) in a display.

Many types of display mechanisms have been described in the prior art that are addressed with electrical or magnetic fields (e.g., U.S. Pat. No. 6,017,584, U.S. Pat. No. 5,961,804, U.S. Pat. No. 4,126,854 are some examples). It is often desired to use these mechanisms to fabricate a display composed of rows and columns of pixels. However, even with fairly low-resolution applications, the total number of pixels quickly becomes very large. In higher resolution applications such as displaying a page of text, for example, the number of pixels can easily exceed 1 Million, 10 Million, or even 100 Million or more. It is generally infeasible to provide individually-controlled electrode and addressing electronics for each individual pixel in such a display.

Instead of individual control electronics for each pixel, such displays typically utilize an X-Y grid of electrodes. A typical prior art X-Y electrode addressing grid is illustrated in FIG. 1. Typically, strips of conductors 30 oriented in one direction (for example, along the rows of pixels) are fabricated on one side of the display 10 and strips of conductors 20 oriented in the opposing direction (along the columns of pixels) are fabricated on the other side of the display. In this manner, the number of control circuits is reduced from the product of the number of rows and columns to the much smaller sum of the number of rows and columns.

The X-Y electrode arrangement can thus apply an electric field to any pixel in the array. However, a problem with such an arrangement is that the strips of conductors also run past other pixels in the same column or row of the array. Due to the capacitance or resistance of each pixel, the voltage on a conductor wire may be coupled through the pixels being addressed to electrodes other than the pixels being actively driven. These other electrodes will then produce weaker electric fields .or current flow on other pixels in the array. The time spent actively driving a given pixel is very small compared to the amount of time the pixel is influenced by the weaker fields leaking during addressing of other pixels. The performance of the display is drastically reduced if not completely infeasible due to the leaking of electric fields.

The prior art solution to this problem has typically been to design one of three mechanisms into each pixel.

If each pixel has a hard threshold that needs to be exceeded before it will switch, the field strength of the secondary leakage can be designed to be lower than this threshold, such that the pixels which are not being addressed will stay as they are. The pixels to be changed are addressed with a field strength higher than this threshold. As an example, U.S. Pat. No. 4,126,854 describes how this may be accomplished using static versus dynamic friction in a twisting ball display. Many types of LCD displays also exhibit such threshold switching properties.

Even if each pixel cannot be made to have a hard-and-fast threshold, various types of non-linearities in the pixel response can be exploited to overcome the problem of fields coupling into the non-driven row and column wires.

If each pixel can be electrically fitted with a semiconductor diode or even a transistor, the problem is circumvented.

The issue is of course how to economically fabricate a display with millions of diodes or transistors incorporated into it. This problem has been solved in the art of LCD displays and is commonly referred to as an active matrix LCD. This technique cannot always be applied to other display technologies due to material and processing constraints being incompatible with the material and processes required to fabricate the transistors. One main limitation of the process used to fabricate the transistors is that the high temperatures used are incompatible with substrates like polycarbonate or other plastics. For this and other reasons, this technique is commonly limited to silicon, glass, or ceramic substrates.

It would be advantageous to provide a technique for addressing pixels in a display which avoids the problem of leakage of electric fields or currents affecting pixels that are not being addressed. It would be further advantageous to provide for the addressing of pixels without the difficulty and expense of requiring a non-linear response or switching elements at each pixel in the display.

The present invention provides methods and apparatus having the aforementioned and other advantages.

SUMMARY OF THE INVENTION

The present invention relates to methods and apparatus for addressing pixels in a display. More particularly, the present invention relates to methods and apparatus for addressing pixels in a display using one or more moving mechanical scanning mechanisms. The one or more movable mechanical scanning mechanisms ("moving addressing elements") and one or more stationary addressing elements provide electrical field addressing for control of the desired pixel(s) in a display.

In an illustrated embodiment of the invention, one or more strips of stationary addressing elements are arranged in a first direction on a first side of a display. One or more moving addressing elements are arranged in a second direction on a second side of the display. The one or more moving addressing elements are positioned adjacent an array of pixels in the display which contains the pixel(s) to be addressed. A pixel actuation field is established between the one or more moving addressing elements and the strip(s) of stationary addressing elements substantially adjacent the pixel(s) to be addressed in the display.

The pixel actuation field may be an electric field, where the one or more moving addressing elements are maintained at a fixed voltage potential. The electric field may be established by applying either a positive voltage or a negative voltage to the stationary addressing element(s) that intersect with the one or more moving addressing elements adjacent the pixel(s) to be addressed.

The one or more moving addressing elements may be driven by a belt-follower and pinion drive system, a lead-screw and lead-nut system, a linear motor system, an incremental piezoelectric drive system, a hydraulic drive system, a magnetic drive system, or any other suitable drive system. In an alternate embodiment, one or more moving addressing elements are adapted to track to a portion of the display which is being updated. The one or more moving addressing elements may track in response to a pointing device associated with the display, such as a mouse, a touch pad, a track ball, or any other suitable pointing device.

The one or more moving addressing elements may be in the form of one or more strips. Alternatively, the one or more moving addressing elements may be in the form of discs, a series of strips, or other suitable form.

In a further embodiment of the invention, the one or more strips of stationary addressing elements may comprise a continuous sheet electrode arranged on a surface of the first side of the display. In such an embodiment, the one or more moving addressing elements may comprise a series of addressing elements each corresponding to a line of pixels in the array of pixels.

The continuous sheet electrode may be a transparent indium-tin-oxide layer on the inside surface of a transparent substrate.

The addressing elements may comprise either electrodes, brushes, electromagnetic coils, or any other suitable addressing elements. Alternatively, the addressing elements may comprise a series of electrodes on a printed wiring board or any other suitable type of addressing elements.

The display may be a liquid crystal display. In a liquid crystal display embodiment, the pixel actuation field may be an electric field. Alternatively, the display may be a micro-encapsulated liquid crystal display, a micro-encapsulated electro-phoretic display, a twisting ball display, a twisting cylinder display, or any other suitable display.

DETAILED DESCRIPTION OF THE INVENTION

The present invention relates to methods and apparatus for addressing pixels in a display. More particularly, the present invention relates to methods and apparatus for addressing pixels in a display using one or more moving mechanical scanning mechanisms. The one or more movable mechanical scanning mechanisms ("moving addressing elements") and one or more stationary addressing elements provide electrical field addressing for control of the desired pixel(s) in a display.

The present invention solves the addressing problem of the X-Y grid by replacing one set of the fixed strips of addressing electrodes with one or more addressing mechanisms that can be physically moved or scanned across the area of the display. By removing the conductor from the proximity of the pixels that are not being addressed, there are no un-driven electrodes having voltage potentials due to leakage currents and thus no electric fields are formed which can affect the un-addressed pixels.

Figure 1:
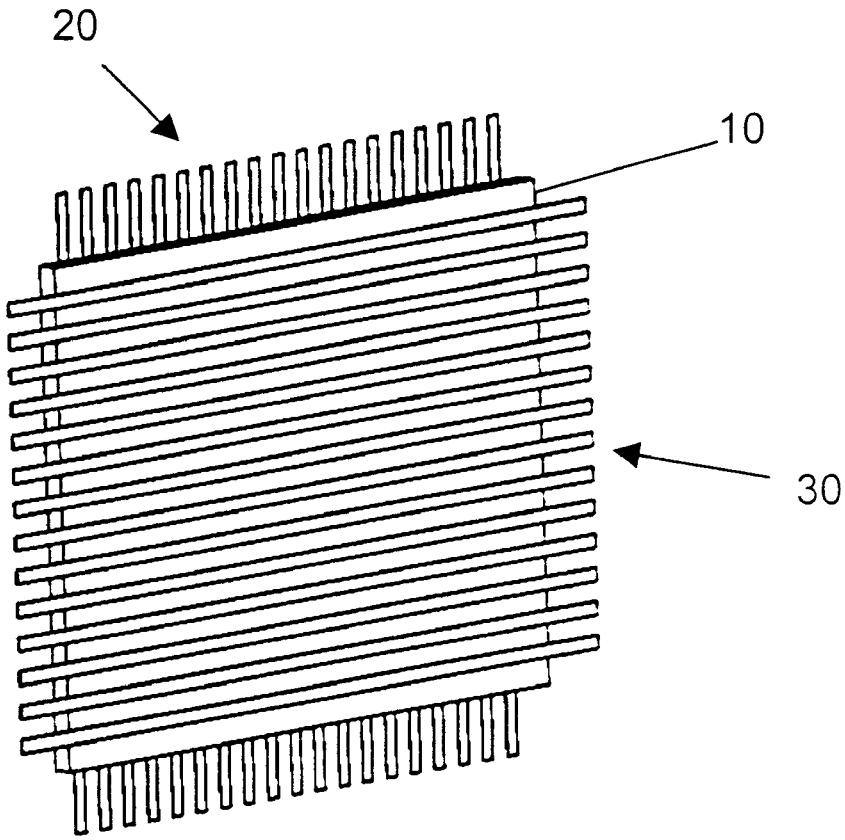
(PRIOR ART) FIG. 1
FIG. 1 is an illustration of a prior art X-Y electrode addressing grid.
Figure 2:
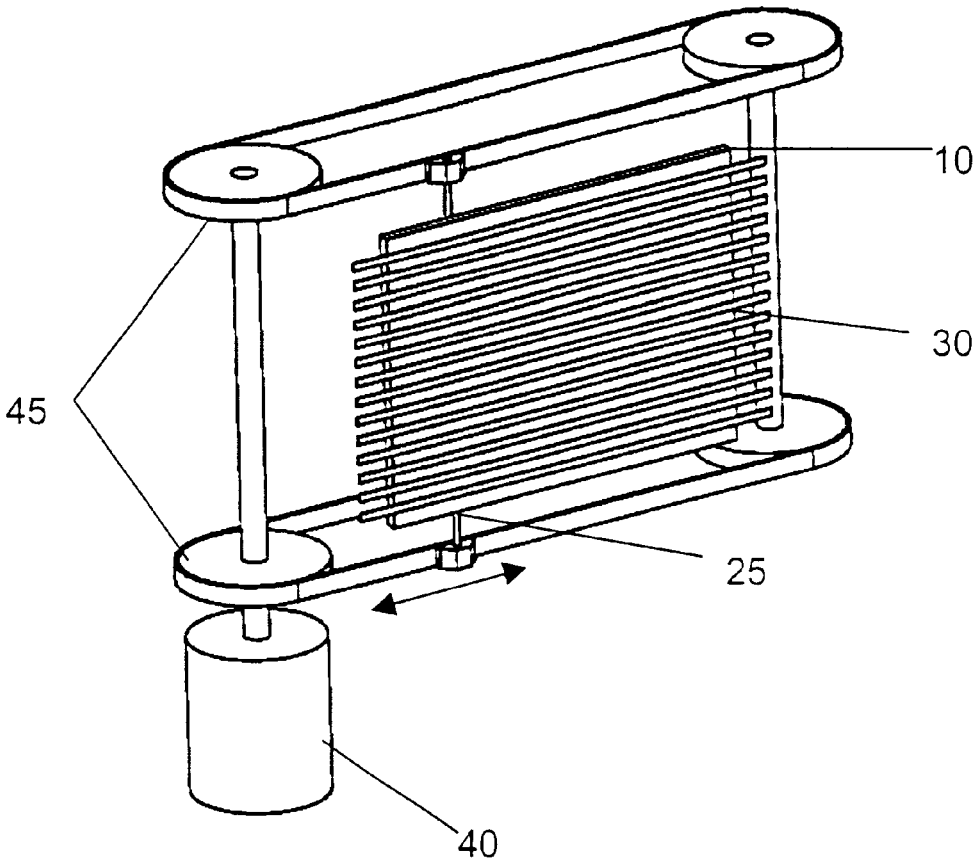
FIG. 2 is an illustration of an embodiment of an apparatus in accordance with the present invention.

In an illustrated embodiment of the invention as shown in FIG. 2, one or more strips of stationary addressing elements 30 are arranged in a first direction on a first side of a display 10. A moving addressing element 25 is arranged in a second direction on a second side of the display 10. Moving addressing element 25 is positioned adjacent an array of pixels in the display 10 which contains the pixel(s) to be addressed. A pixel actuation field is established between moving addressing element 25 and the strip(s) of stationary addressing elements 30 substantially adjacent the pixel(s) in the display 10 to be addressed. The moving addressing element 25 may comprise one or more moving addressing elements.

To write an image to the display, moving addressing element 25 is positioned adjacent a predetermined column of pixels (e.g., the first column of pixels) and its electrical potential is held at a first voltage (ground potential or 0 Volts is a preferred choice, for example). Stationary addressing elements 30 are driven to positive and negative voltages according to the desired display states of the pixels on each row in that column. After some switching time, moving addressing element 25 is moved to the next column in the display 10 and stationary addressing elements 30 are switched to the appropriate states for the pixels in that column. The process is repeated across the area of the display 10.

The positioning of moving addressing element 25 and stationary addressing elements 30 are interchangeable (i.e., the moving addressing element 25 can be positioned adjacent a row of pixels and the stationary addressing elements 30 can be positioned adjacent columns of pixels).

The present invention is most directly applicable to displays where the pixels, in the absence of an electric field, tend to remain in the state they were addressed for at least as long as it will take to address the remainder of the display and return and refresh them. Many display technologies such as LCD's and the electro-phoretic displays described in U.S. Pat. No. 4,126,854, U.S. Pat. No. 5,961,804, and U.S. Pat. No. 6,017,584 have this property. However, as will be apparent to those skilled in the art, the invention is also applicable to displays employing other types of pixels.

The pixel actuation field may be an electric field, where, for example, moving addressing element 25 is maintained at a fixed voltage potential. The electric field may be established by applying either a positive voltage or a negative voltage to stationary addressing element(s) 30 that intersect with moving addressing element 25 adjacent the pixel(s) to be addressed.

In the embodiment shown in FIG. 2, moving addressing element 25 is driven by a servo-motor 40 and a linear-motion belt system 45. It is appreciated that there are many other types of linear motion systems that would be suitable. For example (but not limited to) moving addressing element 25 may be driven by a belt-follower and pinion drive system, a lead screw and lead-nut system, a linear motor system, an incremental piezoelectric drive system, a hydraulic drive system, a magnetic drive system, or any other suitable drive system.

Figure 3:
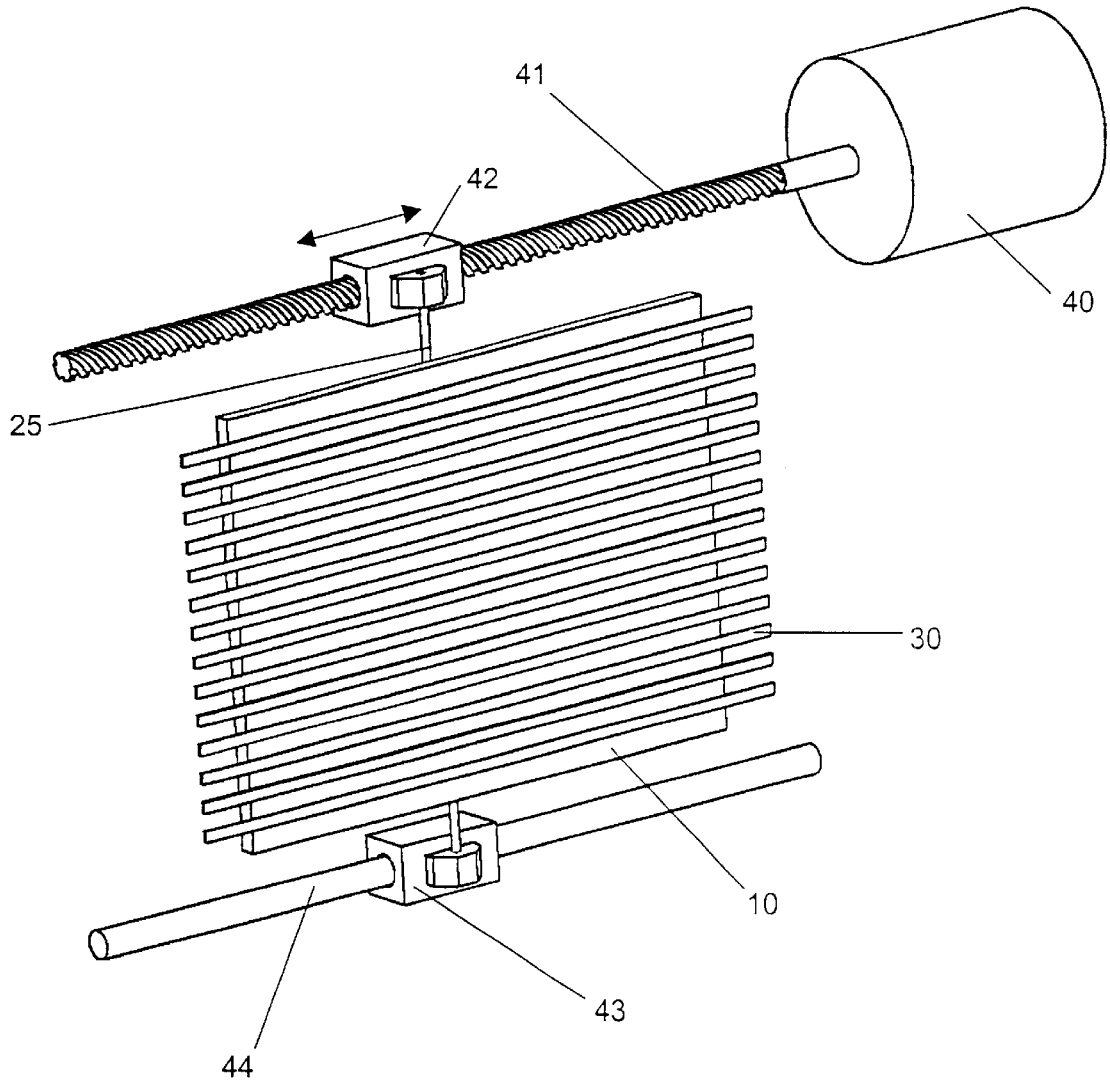
FIG. 3 is an illustration of an embodiment of an apparatus in accordance with the present invention utilizing an alternate drive mechanism.

For example, FIG. 3 shows an embodiment of the invention employing a lead screw and lead-nut system. A motor 40 is connected to a lead screw 41. The lead screw 41 passes through a lead nut 42, which is connected to the addressing element 25. As the lead screw 41 is turned by the motor 40, the lead nut 42 moves along the lead screw 41, thereby moving the addressing element 25. For stability, the addressing element 25 may also be connected to a linear bearing 43 which rides on a guide rod 44. The linear bearing 43 is movable along the guide rod 44 in conjunction with the movement of the lead nut 42.

In some applications, it may be desired to update only a small localized portion of the display 10 at a given time. By limiting the travel of a moving addressing element to only the pixels in the display 10 requiring update, faster update rates may be possible. The travel need not be uni-directional or even to sequential columns, but moving addressing element 25 could track or servo in response to which pixels are being updated.

Figure 4:
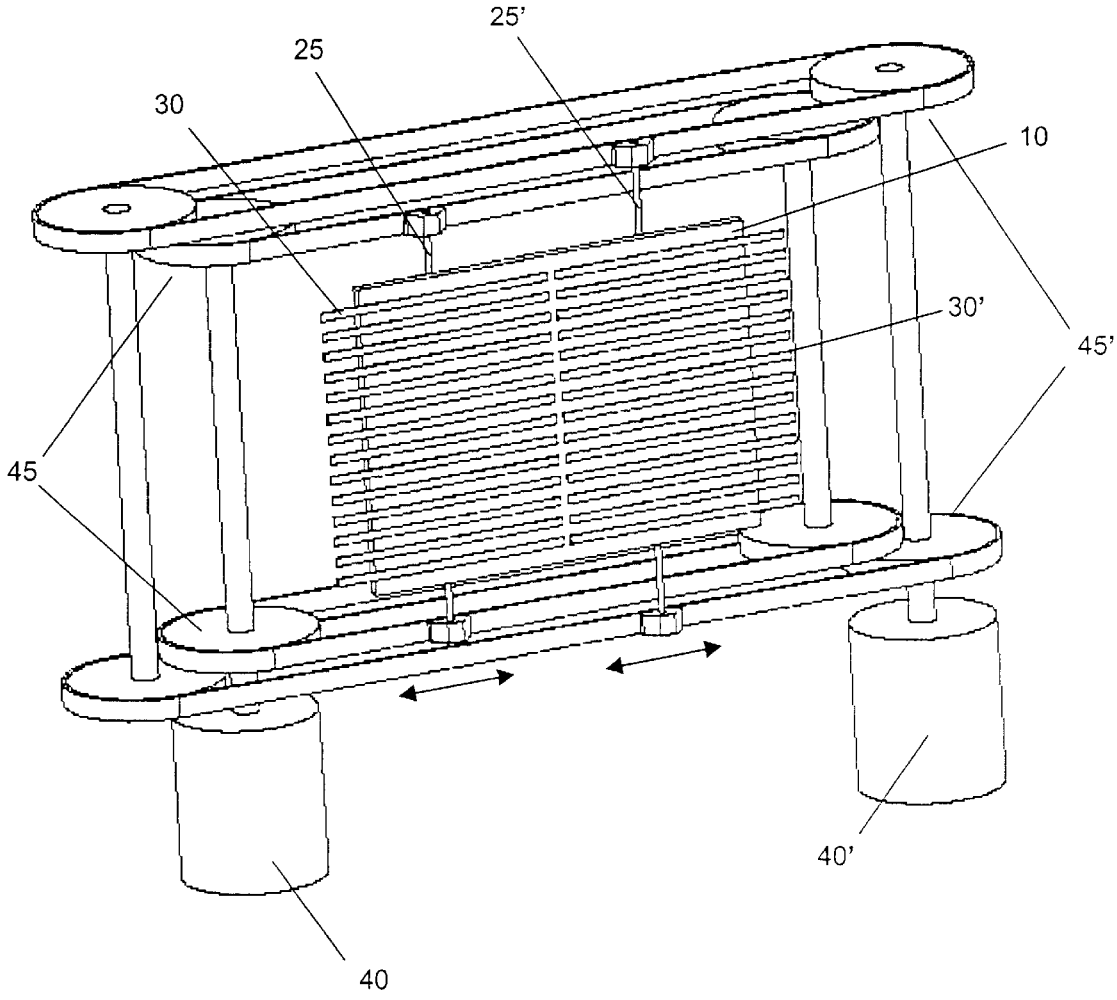
FIG. 4 is an illustration of an alternate embodiment of an apparatus in accordance with the present invention having multiple moving addressing elements and multiple drive elements.

More than one moving addressing element may be provided to allow for faster display update rates. For example, FIG. 4 shows an embodiment of the invention employing two moving addressing elements 25 and 25'. Corresponding sections of stationary addressing elements 30 and 30' are provided. Each moving addressing element 25 and 25' addresses a portion of the display 10 by establishing an electric field between the moving addressing elements 25 and 25' and the corresponding section of stationary addressing elements 30 and 30'. In other words, moving addressing element 25 is capable of addressing pixels in the portion of the display 10 adjacent to the stationary addressing element 30. The moving addressing element 25' is capable of addressing pixels in the portion of the display 10 adjacent to the stationary addressing element 30'. In the embodiment shown in FIG. 4, the moving addressing elements 25 is driven by servo-motor 40 and a linear-motion belt system 45. Moving addressing element 25' is driven by a servo-motor 40' and a linear motion belt system 45'.

Moving addressing element 25 may track in response to a pointing device associated with the display 10. As an example, moving addressing element 25 may move to a portion of the display 10 in response to the tracking of a mouse, touch pad, trackable, or any suitable pointing device to accomplish electronic "writing"or "drawing" on the display surface at rates that keep up with a user's movements.

Moving addressing elements may be in the form of a strip. Alternatively, moving addressing elements may be in the form of disc, a series of strips, or other suitable form as needed for a particular application.

Figure 5:
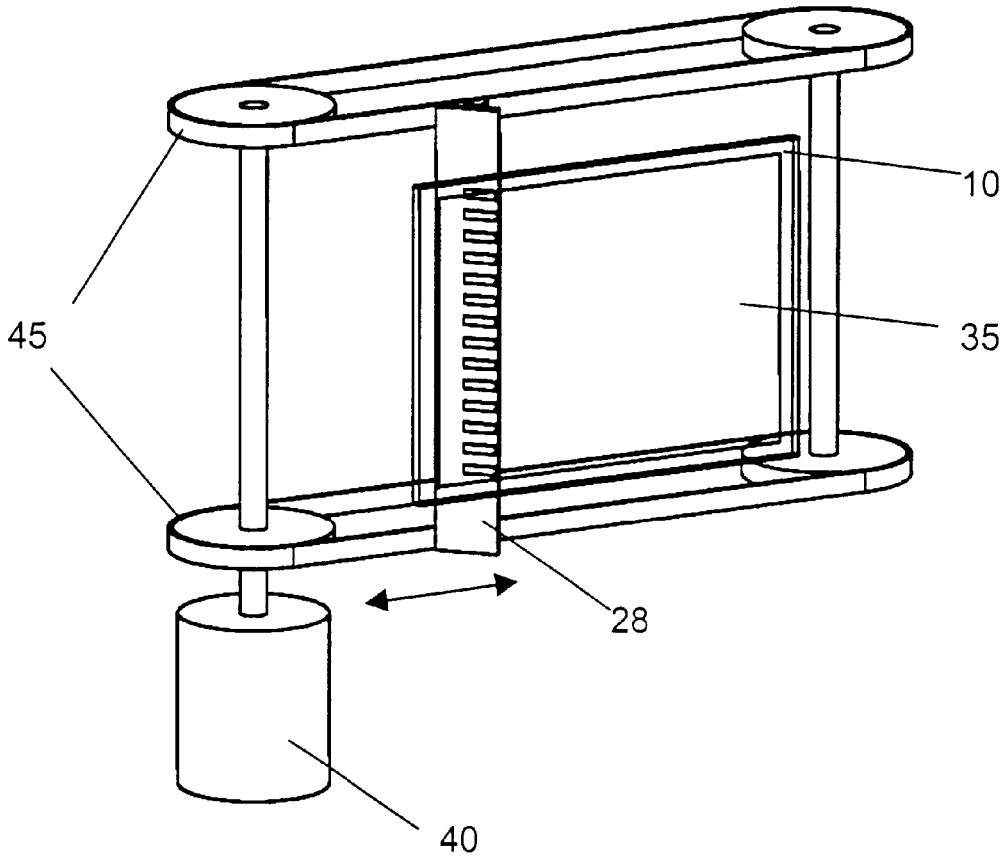
FIG. 5 is an illustration of a further embodiment of an apparatus in accordance with the present invention.

In a further embodiment of the invention as shown in FIG. 5, the one or more strips of stationary addressing elements may comprise a continuous sheet electrode 35 arranged on a surface of the first side of the display 10. In such an embodiment, moving addressing element 28 may comprise a series of addressing elements each corresponding to a line of pixels in the array of pixels.

Continuous sheet electrode 35 may be a transparent indium-tin-oxide layer on the inside surface of a transparent substrate.

Addressing elements 28 may comprise either electrodes, brushes, or electromagnetic coils. Alternatively, addressing-elements 28 may comprise a series of electrodes on a printed wiring board. One example would be a printed wiring board with appropriate drive circuitry and electrode pads positioned proximal to the display surface, one per pixel row or column.

Figure 6:
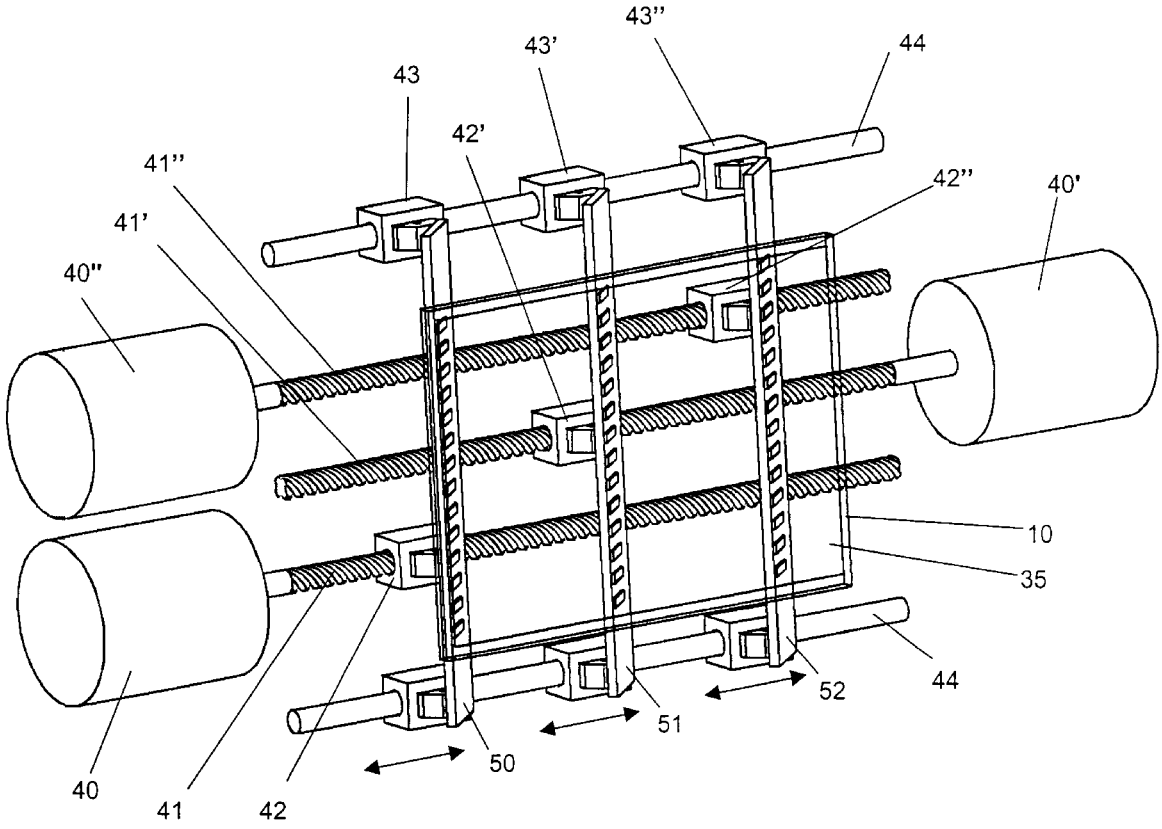
FIG. 6 is an illustration of a further embodiment of an apparatus in accordance with the present invention having multiple moving addressing elements and multiple drive elements.

FIG. 6 shows an embodiment of the invention having three separate series of electrodes mounted on a printed wiring board (PWBs) 50, 51, and 52. In the embodiment shown, the PWBs are each moved via a lead screw and lead-nut system. The operation of such a system is described generally above in connection with FIG. 3. PWB 50 is driven by motor 40 in connection with lead screw 41 and lead nut 42. PWB 51 is driven by motor 40' in connection with lead screw 41' and lead nut 42'. PWB 52 is driven by motor 40" in connection with lead screw 41" and lead nut 42". Each PWB 50, 51, 52 is guided respectively by linear bearings 43, 43' and 43", which are movable along guide rods 44. Display 10 is shown in FIG. 6 as a transparent display for ease of illustration of this embodiment. In the example shown in FIG. 6, three PWBs are shown which are moved by a lead screw and lead nut system. The invention may be employed using any number of PWBs in the same manner as described in connection with FIG. 6. In addition, alternate drive mechanisms as discussed elsewhere herein may be used with the multiple PWBs.

Display 10 may be a liquid crystal display. In a liquid crystal display embodiment, the pixel actuation field may be an electric field. Alternatively, the display may be a micro-encapsulated liquid crystal display, a micro-encapsulated electro-phoretic display, a twisting ball display, a twisting cylinder display, or any other suitable display.

It should now be appreciated that the present invention provides improved methods and apparatus for addressing pixels in a display. In particular, the present invention provides improved methods and apparatus for addressing pixels in a display which avoids the problem of leakage of electric fields affecting pixels which are not being addressed. In addition, the present invention provides for the addressing of pixels without the difficulty and expense of requiring a non-linear response or switching elements at each pixel in the display.

Although the invention has been described in connection with various preferred embodiments, it should be appreciated that numerous adaptations and modifications can be made thereto without departing from the scope of the invention as set forth in the claims. In particular, the invention can be used with many different types of display devices. In addition, moving addressing elements can take a variety of forms and can be moved by varying means.

What is claimed is:

1. A method for addressing pixels in a display, comprising:

providing a plurality of strips of stationary addressing elements arranged in a first direction on a first side of said display;

providing a moving addressing elements arranged in a second direction on a second side of said display, said moving addressing element comprising a strip electrode which intersects said stationary addressing elements at a plurality of pixel locations;

positioning the moving addressing elements adjacent an array of pixels in said display, said array containing one or more pixels to be addressed; and establishing a pixel actuation field between the moving addressing element and one or more of the strips of stationary addressing elements substantially adjacent the pixel(s) in said display to be addressed;

wherein differing pixel actuation fields are established between the moving addressing element and respective strips of stationary addressing elements in order to provide different values to respective pixels to be addressed.

2. A method in accordance with claim 1, wherein:

said pixel actuation field is an electric field; and the moving addressing elements is maintained at a fixed voltage potential.

3. A method in accordance with claim 2, wherein the electric field is established by applying one of a positive voltage or a negative voltage to the stationary addressing elements that intersect with the moving addressing elements adjacent the pixel(s) to be addressed.

4. A method in accordance with claim 1, wherein the moving addressing elements is driven by one of a belt-follower and pinion drive system, a lead-screw and lead-nut system, a linear motor system, a hydraulic drive system, a magnetic drive system, or an incremental piezoelectric drive system.

5. A method in accordance with claim 1, wherein the moving addressing elements tracks in response to a pointing device associated with the display and said moving addressing element is not physically integral to said pointing device.

6. A method in accordance with claim 1, wherein the stationary strip electrodes are a transparent indium-tin-oxide layer on a surface of a transparent substrate.

7. A method in accordance with claim 1, wherein the stationary strip electrodes comprise a series of traces on a printed wiring board.

8. A method in accordance with claim 1, wherein said display is a liquid crystal display.

9. A method in accordance with claim 8, wherein said pixel actuation field is an electric field.

10. A method in accordance with claim 1, wherein the display is one of a micro-encapsulated liquid crystal display, a micro-encapsulated electro-phoretic display, a twisting ball display, or a twisting cylinder display.

11. A method in accordance with claim 1, wherein said moving addressing elements comprises one or more strips.

12. A method for addressing pixels in a display, comprising:

providing one or more strips of stationary addressing elements arranged in a first direction on a first side of said display;

providing one or more moving addressing elements arranged in a second direction on a second side of said display, said one or more moving addressing elements enabled to track to a portion of the display which is being updated in response to a remote pointing device associated with the display;

positioning the one or more moving addressing elements adjacent an array of pixels in said display containing the pixel(s) to be addressed; and establishing a pixel actuation field between the one or more moving addressing element and the strip(s) of stationary addressing elements substantially adjacent the pixel(s) in said display to be addressed.

13. A method in accordance with claim 12, wherein:

the one or more strips of stationary addressing elements comprise a continuous sheet electrode arranged on a surface of the first side of the display; and the one or more moving addressing elements comprises a series of addressing elements each corresponding to a line of pixels in the array of pixels.

14. Apparatus for addressing pixels in a display, comprising:

a plurality of strips of stationary addressing elements arranged in a first direction on a first side of said display; and a moving addressing elements arranged in a second direction on a second side of said display, said moving addressing element comprising a strip electrode which intersects said stationary addressing elements at a plurality of pixel locations; wherein:

the moving addressing element is positioned adjacent an array of pixels in said display, said array of pixels containing one or more pixels to be addressed; and a pixel actuation field is established between the moving addressing elements and one or more of the strips of stationary addressing elements substantially adjacent the pixel(s) in said display to be addressed; and differing pixel actuation fields are established between the moving addressing element and respective strips of stationary addressing elements in order to provide different values to respective pixels to be addressed.

15. Apparatus in accordance with claim 14, wherein:

said pixel actuation field is an electric field; and the moving addressing elements is maintained at a fixed voltage potential.

16. Apparatus in accordance with claim 15, wherein the electric field is established by applying one of a positive voltage or a negative voltage to the stationary addressing elements that intersect with the moving addressing elements adjacent the pixel(s) to be addressed.

17. Apparatus in accordance with claim 14, wherein the moving addressing elements is driven by one of a belt-follower and pinion drive system, a lead-screw and lead-nut system, a linear motor system, a hydraulic drive system, a magnetic drive system, or an incremental piezoelectric drive system.

18. Apparatus in accordance with claim 14, wherein the moving addressing elements tracks in response to a pointing device associated with the display and said moving addressing element is not physically integral with said pointing device.

19. Apparatus in accordance with claim 14, wherein the stationary strip electrodes are a transparent indium-tin-oxide layer on a surface of a transparent substrate.

20. Apparatus in accordance with claim 14, wherein the stationary strip electrodes comprise a series of traces on a printed wiring board.

21. Apparatus in accordance with claim 14, wherein said display is a liquid crystal display.

22. Apparatus in accordance with claim 21, wherein said pixel actuation field is an electric field.

23. Apparatus in accordance with claim 14, wherein the display is one of a micro-encapsulated liquid crystal display, a micro-encapsulated electro-phoretic display, a twisting ball display, or a twisting cylinder display.

24. Apparatus in accordance with claim 14, wherein said moving addressing elements comprises one or more strips.

25. Apparatus for addressing pixels in a display, comprising:

one or more strips of stationary addressing elements arranged in a first direction on a first side of said display; and one or more moving addressing elements arranged in a second direction on a second side of said display; wherein:

the one or more moving addressing elements are positioned adjacent an array of pixels in said display containing the pixel(s) to be addressed;

a pixel actuation field is established between the one or more moving addressing elements and the strip(s) of stationary addressing elements substantially adjacent the pixel(s) in said display to be addressed; and the one or more moving addressing elements track to a portion of the display which is being updated in response to a remote pointing device associated with the display.

26. Apparatus in accordance with claim 25, wherein:

the one or more strips of stationary addressing elements comprise a continuous sheet electrode arranged on a surface of the first side of the display; and the one or more moving addressing elements comprises a series of addressing elements each corresponding to a line of pixels in the array of pixels.

* * * * *

UNITED STATES PATENT AND TRADEMARK OFFICE

CERTIFICATE OF CORRECTION

PATENT NO. : 6,753,845 B1
DATED : June 22, 2004
INVENTOR(S) : Keeney et al.

It is certified that error appears in the above-identified patent and that said Letters Patent is hereby corrected as shown below:

Column 6,
Lines 26 and 31, 46, 54 and 59, correct “elements” to read -- element --.

Column 7,
Lines 10, 34, 51 and 60, correct “elements” to read -- element --.

Column 8,
Lines 4, 7, 13, 52 and 54, correct “elements” to read -- element --.

Signed and Sealed this

Seventh Day of September, 2004

JON W. DUDAS
*Director of the United States Patent and Trademark Office*